US007647156B2

(12) United States Patent
Mischler et al.

(10) Patent No.: US 7,647,156 B2
(45) Date of Patent: Jan. 12, 2010

(54) METHOD AND SYSTEM FOR USING EXHAUST TEMPERATURE ANOMALIES TO DETECT FUGITIVE FUELING OF A RECIPROCATING INTERNAL COMBUSTION ENGINE

(75) Inventors: James R. Mischler, Girard, PA (US); Luke M. Henry, Erie, PA (US); Nikita Goel, Erie, PA (US); Kyle C. Stott, Erie, PA (US)

(73) Assignee: General Electric Company, Schenectady, NY (US)

( * ) Notice: Subject to any disclaimer, the term of this patent is extended or adjusted under 35 U.S.C. 154(b) by 33 days.

(21) Appl. No.: 11/956,435

(22) Filed: Dec. 14, 2007

(65) Prior Publication Data

US 2009/0157278 A1 Jun. 18, 2009

(51) Int. Cl.
*F02D 41/00* (2006.01)

(52) U.S. Cl. ..... 701/102; 123/357; 73/114.42

(58) Field of Classification Search ..... 701/101–105, 701/107, 112; 123/357, 358, 676; 73/114.42, 73/114.56, 114.55, 114.69

See application file for complete search history.

(56) References Cited

U.S. PATENT DOCUMENTS

| | | | | |
|---|---|---|---|---|
| 4,136,329 | A * | 1/1979 | Trobert | 340/459 |
| 5,979,160 | A * | 11/1999 | Yashiki et al. | 60/276 |
| 6,067,498 | A * | 5/2000 | Akiyama | 701/110 |
| 7,139,658 | B2 * | 11/2006 | Satoya | 701/114 |
| 7,140,241 | B2 * | 11/2006 | Wakahara | 73/114.39 |
| 7,315,778 | B1 * | 1/2008 | Kumar | 701/104 |
| 7,433,777 | B2 * | 10/2008 | Ikari et al. | 701/103 |
| 7,444,229 | B1 * | 10/2008 | Mischler et al. | 701/104 |
| 2008/0054647 | A1 * | 3/2008 | Kumar | 290/40 R |

* cited by examiner

*Primary Examiner*—Stephen K Cronin
*Assistant Examiner*—Johnny H Hoang
(74) *Attorney, Agent, or Firm*—GE Global Patent Operation

(57) ABSTRACT

A method and system for using exhaust temperature anomalies to detect fugitive fueling of a reciprocating internal combustion engine compares an exhaust temperature attribute with a predetermined threshold value for such attribute, which is a function of either the combustion of fugitive fuel within the engine, or an indicator of an operating condition leading to fugitive fueling. If the value of the attribute exceeds the threshold value, remedial action will be taken to avoid engine damage resulting from fugitive fueling.

9 Claims, 5 Drawing Sheets

METHOD AND SYSTEM FOR USING EXHAUST TEMPERATURE ANOMALIES TO DETECT FUGITIVE FUELING OF A RECIPROCATING INTERNAL COMBUSTION ENGINE

CROSS REFERENCE TO RELATED APPLICATIONS

None.

BACKGROUND OF THE INVENTION

1. Field of the Invention

The subject matter disclosed herein relates to the use of specific exhaust temperature anomalies in multi-cylinder internal combustion engines to detect unwanted fugitive fueling.

2. Discussion of the Prior Art

As used herein, the term "fugitive fueling" means a phenomenon in which an engine receives fuel in excess of that which the engine's fuel controller intends to deliver, either by injectors or by another fuel delivery device. Fugitive fueling may occur in a variety of situations. For example, if an engine is operated in a hydrocarbon contaminated atmosphere, such as could occur in the event of a spill at a petroleum transfer terminal or a recycling facility, sufficient unwanted, or fugitive, hydrocarbons may be inducted by the engine's air system to cause overspeed and severe engine damage. A mishap such as vehicular accident or train wreck may create fugitive fueling situations as well.

Another type of fugitive fueling may occur due to a leak in an engine lubrication system. Such leaks may occur in a turbocharger or other component connected with the engine's air inlet system. Those skilled in the art will appreciate that engines, particularly diesel engines, are capable of operating quite well on lubricating oil, including lubricating oil aspirated into the engine's cylinders as a result of failure in a component such as a turbocharger bearing, or a failure such as the dropping of a cylinder poppet valve. In any case, fugitive fueling may provide hundreds of horsepower worth of fuel to a large engine which is sufficient to cause the engine to overspeed if the engine is unloaded.

Known systems and methods monitor engine speed and attempt to limit overspeeding by controlling fuel delivery. This method of control may not be effective in the case of engines which exhibit overspeeding only after a significant time has passed since the onset of a fugitive fueling event, because the passage of time frequently allows a large quantity of lubricating oil to build up improperly within a location accessible to the engine's air inlet system. Once this occurs, fuel limiting may not be sufficient to prevent a damaging overspeed event.

A need exists for a system and method to detect and respond to fugitive fueling before an engine overspeeds, and indeed, prior to the build-up of lubricating oil which could cause a deleterious overspeed event.

BRIEF DESCRIPTION OF THE INVENTION

According to an aspect of the present invention, a method for detecting fugitive fueling of an internal combustion engine by monitoring exhaust temperature anomalies includes monitoring at least one exhaust temperature attribute which is a function of the combustion of fugitive fuel within the engine and comparing the value of the at least one temperature attribute with the predetermined threshold value. If the value of the temperature attribute exceeds the threshold value, an engine operator will be notified that fugitive fueling is occurring. Also, remedial action will be taken to prevent engine damage from the fugitive fueling.

According to an aspect of the present invention, an exhaust temperature attribute useful for practicing the invention may be determined as the differences, if any, between the bulk exhaust temperatures of a plurality of separate banks of cylinders of an engine. These differences are preferably measured upstream from a turbocharger connected with, and receiving exhaust from, the separate banks of cylinders. Alternatively, according to an aspect of the present invention, an exhaust temperature attribute useful for practicing the invention may include a bulk exhaust temperature which is compared with a predicted bulk exhaust temperature determined as a function of the contemporaneous power output of the engine. A predicted bulk exhaust temperature may, alternatively, be determined as a function of the quantity of fuel being furnished to the engine's cylinders. As yet another alternative, the bulk exhaust temperature may be compared with the predetermined bulk exhaust temperature drawn from a look up table in the engine's controller. The engine controller preferably comprises at least one microprocessor controller.

According to another aspect of the present invention, a system for detecting fugitive fueling of an internal combustion engine includes a controller for monitoring at least one exhaust temperature attribute which is a function of the combustion of fugitive fuel within the engine. Temperatures may be measured either at individual cylinder banks or as a bulk temperature measured at a flow point in the exhaust system wherein the gasses from all the engine's cylinders have been merged. The system compares either the difference between bulk temperatures of different banks of cylinders or the merged bulk temperature, which is compared with an expected temperature according to the contemporaneous horsepower output of the engine. In the event that either the temperature attribute exceeds the threshold, remedial action will be taken to prevent damage to the engine from fugitive fueling.

It is an advantage of the system according to the present invention that fugitive fueling may be detected rapidly and in sufficient time to take remedial action to avoid damage to an engine.

It is another advantage of a method and system according to the present invention that fugitive fueling may be detected without expensive and complicated sensing and/or analysis of data.

Other advantages, as well as features, of the present invention will become apparent to the reader of this specification.

DETAILED DESCRIPTION OF THE PREFERRED EMBODIMENTS

Figure 1:
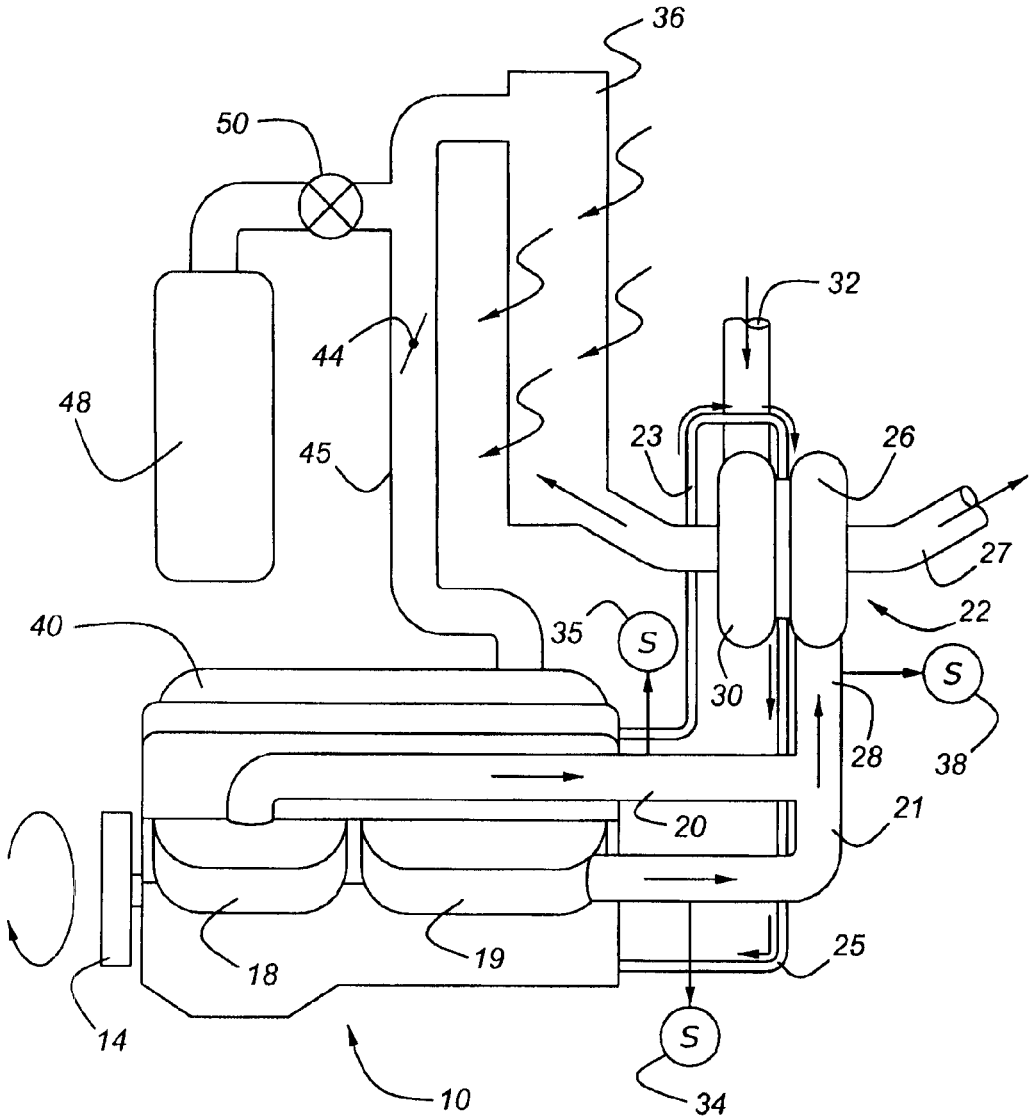
FIG. 1 is a schematic representation of an internal combustion engine having an exhaust temperature anomaly detection system for detecting fugitive fueling.
Figure 2:
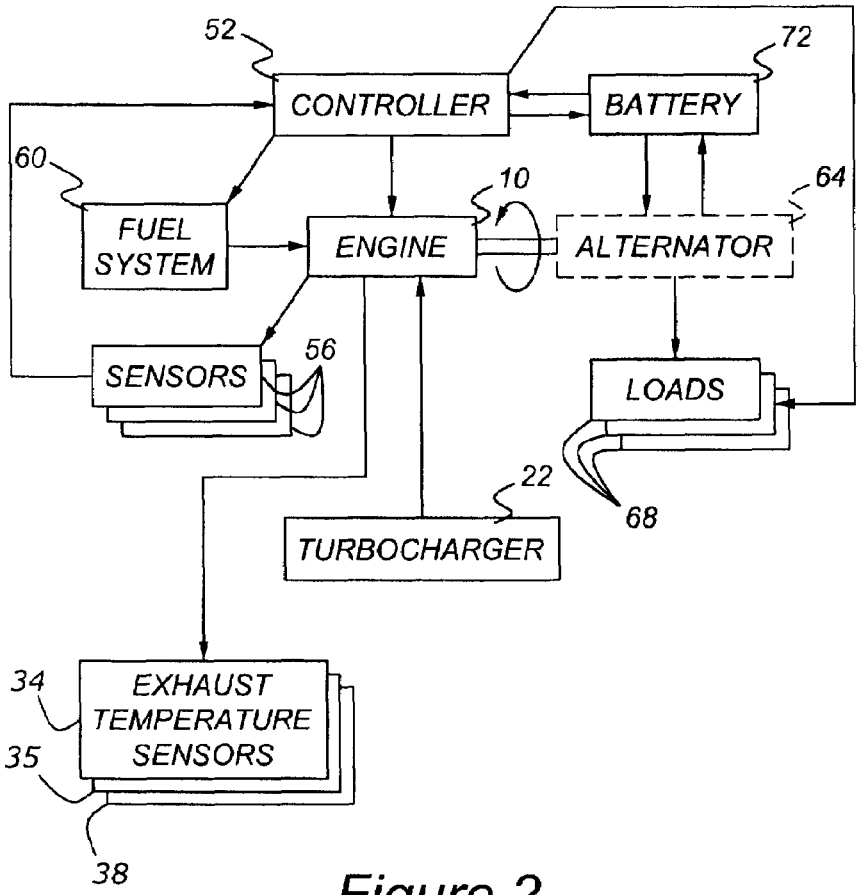
FIG. 2 is a block diagram of a complete engine system according to an aspect of the present invention.

As shown in FIG. 1, engine 10 has a crankshaft 14, which is shown in FIG. 2 as being connected with alternator 64 or other engine load. Typically, if engine 10 were used in a diesel electric locomotive or in a stationary power unit, or even aboard many vessels, engine 10 would be coupled directly to an alternator such as that illustrated in FIG. 2.

Engine 10 also includes a split exhaust system having two exhaust manifolds 18 and 19. Exhaust manifold 18 is connected with exhaust downpipe 20, and exhaust manifold 19 is connected with exhaust downpipe 21. Downpipes 20 and 21 come together at common section 28 before entering turbocharger 22. Exhaust gases entering turbocharger 22 pass through exhaust turbine 26 and then through exhaust pipe 27. Exhaust turbine 26 turns compressor section 30, and air entering turbocharger by means of air inlet 32 is compressed and then enters intercooler 36 before passing into air supply pipe 45 and intake manifold 40. Engine 10 also has a turbo oil supply line, 23, which furnishes lubricating oil to turbocharger 22. Oil leaving the turbocharger passes through return oil line 25.

Air may be prevented from entering intake manifold 40 by means of air shutter 44. Alternatively, engine 10 may be stopped in an emergency by means of inert gas within tank 48 and valve 50, which allows controller 52 (FIG. 2) to quickly stop the engine if fugitive fueling is determined by the present system to be likely.

Engine 10 has a number of exhaust temperature sensors. Sensor 35 measures the exhaust temperature in downpipe 20, whereas sensor 38 measures the temperature in bulk gasses downstream of both sensor 35 and also sensor 34, which measures the exhaust temperature in downpipe 21.

Figure 4:
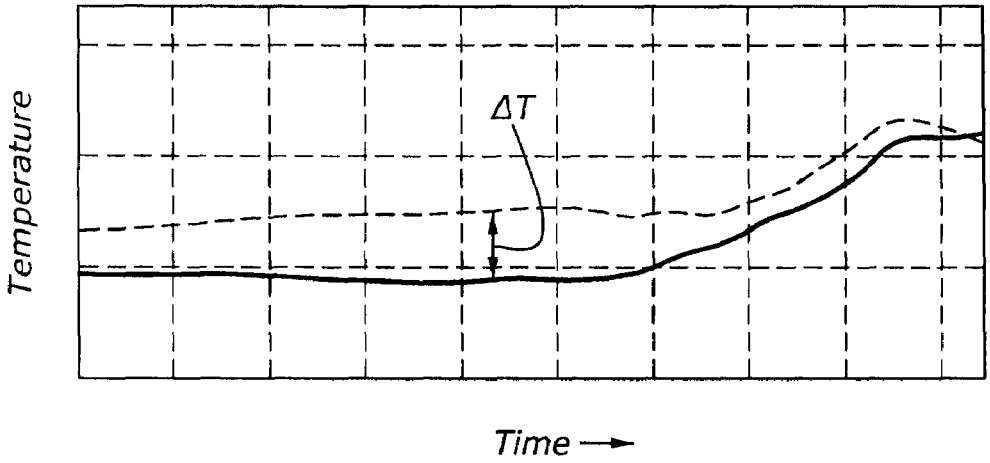
FIG. 4 illustrates a bank-to-bank temperature anomaly indicating fugitive fueling according to an aspect of the present invention.

Moving now to FIG. 4, the utility of sensing the exhaust temperature in both downpipe 20 and downpipe 21 is shown. In this plot, the temperature difference, $\Delta T$, between banks of cylinders served by exhaust manifold 18 and exhaust manifold 19 is shown. If the differential temperature exceeds a calibratable amount, say about 150° for one known engine, this means that, in essence, the bank of cylinders has suffered a change in operating conditions which could include the onset of a fugitive fueling event. For example one of the cylinders in the cooler bank may have dropped an intake or exhaust poppet valve, with the result that the temperature of the exhaust gas leaving that bank is lowered below the value for the other cylinder bank, which is presumed to be operating properly. Fugitive fueling will gradually occur because of an unwanted leak path created when the valve becomes dislodged and enters the combustion chamber. In essence, lubricating oil may be transferred into the intake manifold because of damage to the cylinder system, and as a result, lubricating oil will be aspirated into the other, undamaged cylinders. When the difference between the bank-to-bank exhaust temperature is in the range of about 150° F., as noted, the conclusion may be made that a pre-condition to fugitive fueling is present, in the form of damage sufficient to ultimately cause fugitive fueling. This indicates that remedial action may be required, as described below. Those skilled in the art will appreciate in view of this disclosure that the precise temperature differential indicative of cylinder system damage likely to lead to fugitive fueling will likely differ with various engines and with various usage cycles. Those skilled in the art will further appreciate in view of this disclosure that other engine abnormalities, such as a damaged fuel transfer pump, or running the engine out of fuel, or camshaft lifter roller failures could cause a substantial difference in bank-to-bank exhaust temperature without also causing fugitive fueling. In such case, remedial action may nevertheless be undertaken and continued until the precise nature of the equipment abnormality is diagnosed.

Figure 5:
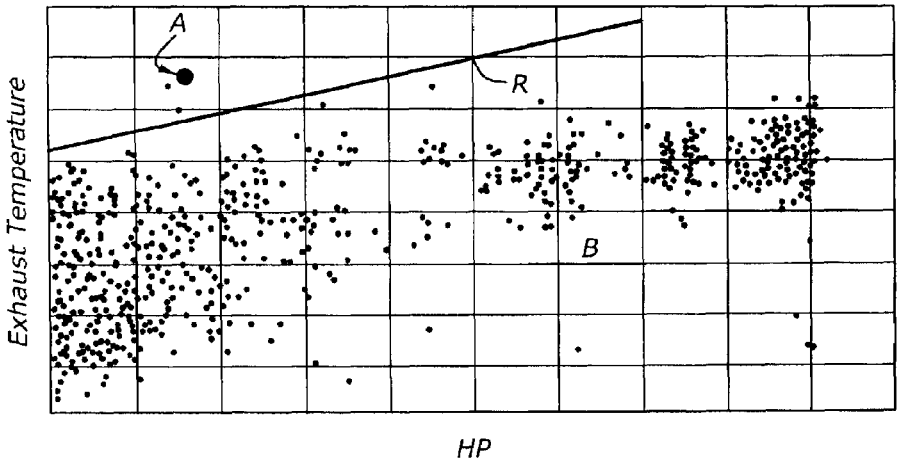
FIG. 5 illustrates a bulk temperature analysis according to an aspect of the present invention.

FIG. 5 illustrates another type of exhaust temperature attribute which can be used to detect fugitive fueling. When an engine is operating above the line R, which shows bulk exhaust temperature versus horsepower this means that the engine is burning lubrication oil in the exhaust manifold and, as a result, the exhaust temperature is much higher than would be expected, given the horsepower output of the engine. Operation at point "A" is an example of operation of an engine with an exhaust temperature greater than would be expected given the engine's horsepower output. As noted above, it is possible with leaks in a large engine to obtain hundreds of horsepower of fugitive fueling from lubricating oil, and this high amount of fugitive fueling will cause an elevated exhaust temperature before the turbocharger, with the temperature being a very good indication that fugitive fueling is occurring. The operating points shown in region B of FIG. 5 were taken from a population of properly operating engines. Thus, line R defines a family of threshold exhaust temperatures which should not be exceeded by a properly operating engine.

Figure 3:
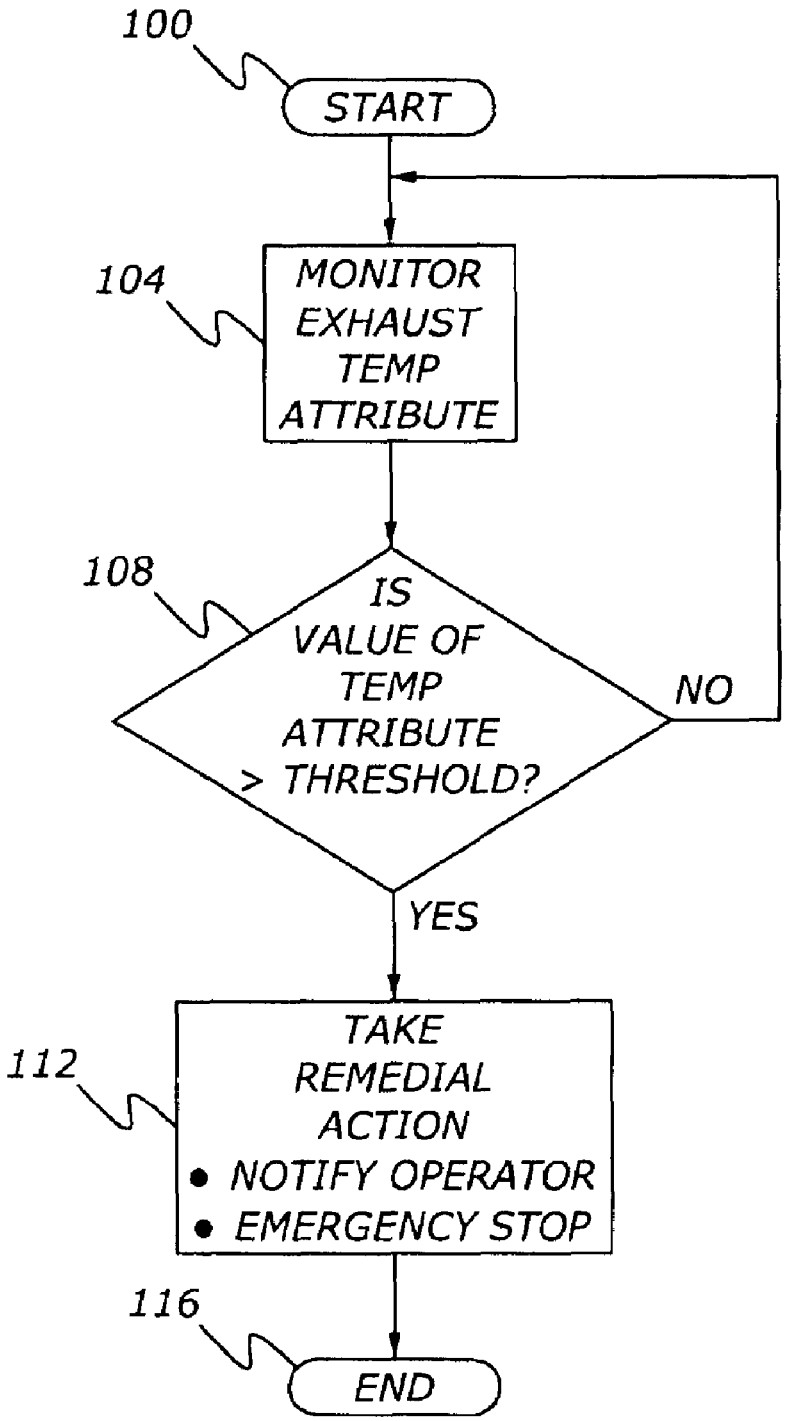
FIG. 3 is a flow chart of a method according to an aspect of the present invention.

FIG. 3 illustrates a method according to the present invention, with controller 52 operating according to the method. As a preface, though, as shown in FIG. 2, controller 52 is connected with a battery, 72, which may be a traction battery or other type of battery, which is charged by alternator 64. Alternator 64 has a variety of loads, 68, attached thereto, including a self-load grid system which is capable of taking the total output of alternator 64. Engine 10 also has a number of sensors 56 other than explicit temperature sensors 34, 35, and 38, which were previously described. Of course, controller 52 operates engine fuel system 60, which may include fuel injection devices and/or other types of electronically controlled fuel delivery devices known to those skilled in the art and suggested by this disclosure.

Continuing now with FIG. 3, controller 52 starts a routine at block 100 and then moves to block 104, wherein an exhaust temperature attribute, whether it be bank-to-bank temperature differential or bulk exhaust temperature, is monitored. Then, at block 108, the value monitored exhaust temperature attribute is compared with a threshold value. If the value of the attribute is less than the threshold value, the routine merely continues at block 104. If, however, the value of the temperature attribute is greater than the threshold value, the routine moves to block 112, wherein remedial action will be taken. Examples of these threshold values were defined in connection with FIGS. 4 and 5.

Remedial action taken in the face of apparent fugitive fueling may include a variety of procedures including: operation of air shutter 44 to starve engine 10 of air; opening of valve 50 to release inert gas into engine 10, again to starve the engine of air; and using self-loading devices, such as resistive elements connected in series with alternator 64 to load engine 10 to an amount exceeding the capability of horsepower generation based on the fugitive fueling. In general, intended fueling will also be ceased immediately upon the suspicion of fugitive fueling.

The remedial action taken in response to apparent fugitive fueling may be rendered more precise by first verifying that fugitive fueling is indeed occurring. This may be accomplished by performing an energy balance on the running engine by comparing the engine's power output with the intentional, or scheduled, fuel flow. In any event, engine 10 will be stopped before damage can occur due to overfueling or fugitive fueling.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method for detecting fugitive fueling of an internal combustion engine, comprising:

monitoring at least one exhaust temperature attribute which is a function of the combustion of fugitive fuel within the engine, wherein the at least one exhaust temperature attribute comprises a difference between a first exhaust temperature of a first separate bank of cylinders of the engine and a second, distinct exhaust temperature of a second separate bank of cylinders of the engine;

comparing the value of said at least one temperature attribute with a predetermined threshold value indicative of an exhaust temperature anomaly caused by fugitive fueling; and if the value of said at least one temperature attribute exceeds said threshold value, notifying an engine operator that a fugitive fueling condition is present.

2. A method according to claim 1, wherein said first exhaust temperature and said second exhaust temperature are measured upstream from a turbocharger connected with, and receiving the exhaust from, said first separate bank of cylinders and said second separate bank of cylinders.

3. A method according to claim 1, wherein said engine operator comprises at least one microprocessor controller.

4. A method according to claim 1, wherein said engine operator comprises at least one human operator.

5. A method for detecting fugitive fueling of an internal combustion engine, comprising:

monitoring at least one exhaust temperature attribute which is a function of the combustion of fugitive fuel within the engine;

comparing the value of said at least one temperature attribute with a predetermined threshold value indicative of an exhaust temperature anomaly caused by fugitive fueling;

if the value of said at least one temperature attribute exceeds said threshold value, notifying an engine operator that a fugitive fueling condition is present; and taking remedial action to mitigate engine damage from fugitive fueling, comprising at least one of: closing an air shutter within an air induction system of the engine; causing an inert gas to be drawn into an air induction system of the engine; connecting a resistive element in series with a rotating electrical machine driven by the engine; and/or stopping all intentional fueling, to prevent the engine from rotating at an excessive speed.

6. A method for detecting fugitive fueling of an internal combustion engine, comprising:

monitoring at least one exhaust temperature attribute which is a function of the combustion of fugitive fuel within the engine;

comparing the value of said at least one temperature attribute with a predetermined threshold value indicative of an exhaust temperature anomaly caused by fugitive fueling;

if the value of said at least one temperature attribute exceeds said threshold value, notifying an engine operator that a fugitive fueling condition is present;

verifying that fugitive fueling is occurring by performing an energy balance upon the running engine by comparing the engine's power output with the intentional, or scheduled, fuel flow, and by taking remedial action to mitigate engine damage from fugitive fueling if fugitive fueling is verified, comprising at least one of: closing an air shutter within an air induction system of the engine;

causing an inert gas to be drawn into an air induction system of the engine; connecting a resistive element in series with a rotating electrical machine driven by the engine; and stopping all intentional fueling, to prevent the engine from rotating at an excessive speed.

7. A method for detecting fugitive fueling of an internal combustion engine, comprising:

measuring the respective, distinct bulk exhaust temperatures of each of a plurality of separate cylinder banks of the engine;

determining the arithmetic differences between the measured values of the bulk exhaust temperatures for said plurality of cylinder banks; and if any of said arithmetic differences exceeds a predetermined threshold value indicative of an exhaust temperature anomaly caused by a precondition leading to fugitive fueling, taking remedial action to mitigate engine damage from fugitive fueling.

8. A system for detecting fugitive fueling of an internal combustion engine, comprising:

a controller for monitoring at least one exhaust temperature attribute which is a function of the combustion of fugitive fuel within the engine;

a comparator for comparing the value of said at least one temperature attribute with a predetermined threshold value indicative of an exhaust temperature anomaly caused by a pre-condition to fugitive fueling; and with the controller taking remedial action directed toward fugitive fueling if the value of said at least one temperature attribute exceeds said threshold value;

wherein said remedial action comprises verifying the presence, if any, of fugitive fueling, followed by at least one of the following if fugitive fueling is verified: closing an air shutter within an air induction system of the engine; causing an inert gas to be drawn into an air induction system of the engine; connecting a resistive element in series with a rotating electrical machine driven by the engine; and/or stopping all intentional fueling.

9. A system according to claim 8, wherein the presence of fugitive fueling is verified by performing an energy balance upon the running engine by comparing the engine's power output with the intentional, or scheduled, fuel flow.

* * * * *

UNITED STATES PATENT AND TRADEMARK OFFICE

CERTIFICATE OF CORRECTION

PATENT NO. : 7,647,156 B2
APPLICATION NO. : 11/956435
DATED : January 12, 2010
INVENTOR(S) : Mischler et al.

It is certified that error appears in the above-identified patent and that said Letters Patent is hereby corrected as shown below:

In Column 4, Line 42, delete "value monitored" and insert -- value of the monitored --, therefor.

Signed and Sealed this

Sixteenth Day of March, 2010

David J. Kappos

David J. Kappos
*Director of the United States Patent and Trademark Office*